US005396309A

United States Patent [19]

Morita et al.

[11] Patent Number: 5,396,309

[45] Date of Patent: Mar. 7, 1995

[54] PHOTOSENSITIVE MATERIAL PROCESSING APPARATUS

[75] Inventors: Satoshi Morita; Hisatsugu Torii, both of Kanagawa, Japan

[73] Assignee: Fuji Photo Film Co., Ltd., Kanagawa, Japan

[21] Appl. No.: 231,839

[22] Filed: Apr. 25, 1994

[30] Foreign Application Priority Data

Apr. 26, 1993 [JP] Japan ..... 5-120450

[51] Int. Cl.[6] ..... G03D 3/08

[52] U.S. Cl. ..... 354/320

[58] Field of Search ..... 354/331, 336, 319–324; 134/64 P, 64 R, 122 P, 122 R

[56] References Cited

FOREIGN PATENT DOCUMENTS

| | | | |
|---|---|---|---|
| 1267648 | 10/1989 | Japan . | |
| 2205846 | 8/1990 | Japan . | |
| 4-068349 | 3/1992 | Japan | 354/323 |
| 5-127340 | 5/1993 | Japan | 354/323 |
| 5127338 | 5/1993 | Japan . | |

*Primary Examiner*—D. Rutledge
*Attorney, Agent, or Firm*—Sughrue, Mion, Zinn, Macpeak & Seas

[57] ABSTRACT

In a photosensitive material processing apparatus, a conveying rack is provided so as to be able to be immersed in and lifted out from both of first and second processing chambers simultaneously. The conveying rack includes a plurality of conveying roller pairs and conveys a photosensitive material from the first to the second processing chamber via a processing solution partitioning member while immersing it in the processing solutions. At least one of the plurality of conveying roller pairs which are provided in the first processing chamber is a one-way rotating conveying roller pair which is rotated only in a rotating direction corresponding to a direction of conveying the photosensitive material. When the conveying rack which is immersed in the first and second processing chambers is lifted out therefrom, levels of the processing solutions in the first and second processing chambers are changed equally. Even if the conveying rack is lifted with the photosensitive material therein, the photosensitive material is smoothly withdrawn and the processing solution partitioning member follows changes in a conveying path of the photosensitive material. Therefore, a function of separating the processing solutions does not deteriorate, and the processing solutions in the first and second processing chambers do not mix.

20 Claims, 6 Drawing Sheets

PHOTOSENSITIVE MATERIAL PROCESSING APPARATUS

BACKGROUND OF THE INVENTION

1. Field of the Invention

The present invention relates to a photosensitive material processing apparatus such as an automatic developer of a silver photographic film or the like, and more particularly to a structure of a processing tank for immersing photosensitive material into a processing solution so as to be developed.

2. Description of the Related Art

In an automatic developer of a silver photographic film, the photosensitive material such as an exposed photographic film has undergone wet-development processing using processing solutions having respective functions such as developing, bleaching, fixing, bleaching/fixing, rinsing, washing, stabilizing and the like. In order to make the apparatus compact, decrease amounts of the processing solutions and shorten the processing time, a processing apparatus having a plurality of processing chambers has been proposed when processing is effected. The processing apparatus is described in Japanese Patent Application Laid-Open No. 1-267648, Japanese Patent Application Laid-Open No. 2-205846 and the like. In these arts, chambers are formed by vertically providing a partitioning wall within a processing tank. The photosensitive material is conveyed to the respective processing chambers, and immersed into the processing solutions accommodated therein. In this way, the photosensitive material is processed.

In Japanese Patent Application Laid-Open No. 5-127338, a structure shown in FIG. 6 has been proposed as a multi-chambered processing tank having a plurality of processing chambers. While the photosensitive material is moved between the processing solutions having different functions, crossover time generates when the photosensitive material is temporarily taken out. In FIG. 6, a processing tank 101 is partitioned by a partitioning wall 103 which extends in the vertical direction so as to omit crossover time and shorten the processing time. Conveying racks 109 and 111, which serve as conveying mechanisms for conveying the photosensitive material, are loaded into the processing tank 101 so as to be mountable and removable. The conveying racks 109 and 111 include a plurality of conveying roller pairs 113. A driving force is transmitted to the conveying roller pairs 113 by gears 115. The photosensitive material is nipped and conveyed by the conveying roller pairs 113. A gap is formed between a lower end portion of the partitioning wall 103 and a bottom portion of the processing tank 101. The photosensitive material can pass through the gap. According to the prior art described in Japanese Patent Application Laid-Open No. 5-127338, the lower portion of the processing tank 101 is filled with solvent having larger specific gravity than the processing solution. Thereafter, the processing chambers on both sides of the partitioning wall 103 are filled with processing solutions having different functions so that the processing solutions do not move below the partitioning wall 103.

Instead of solvent, a similar effect can be obtained by providing a processing solution partitioning member which allows passage of the photosensitive material but prevents movement of the processing solutions. In the structure shown in FIG. 6, the photosensitive material can move between the different processing solutions without being taken out, and the processing time can be shortened by omitting the crossover time.

Here, the processing solutions having different functions include not only a case in which types of the processing solutions are completely different but also a case in which types of the processing solutions are the same but abilities of the processing solutions are different due to the difference in fatigue, concentration or the like. Accordingly, the processing chambers on both sides of the partitioning wall 103 are filled with the same type of processing solution, and the photosensitive material can be processed in a plurality of steps.

The photosensitive material conveying mechanisms are lifted from the processing tank when the photosensitive material conveying mechanisms or the processing tanks are cleaned, or in order to clear the photosensitive material jam. However, in any structure, the liquid may leak from the processing tank, thereby mixing the processing solutions between the processing chambers. Thereafter, processing would be interrupted. As in a wash processing, if the same processing is preferably effected in a multi-stage countercurrent cascade, it is desirable that the concentration of contaminates in the processing solution be gradually decreased from the upstream side to the downstream side of the conveying direction of the photosensitive material. If the concentration of contaminates in the processing solution is substantially the same, the washing effect is reduced. In the case of the previously-described multi-chambered processing tank, in which the plurality of processing chambers are provided by the partitioning wall, when the conveying mechanisms are lifted from the processing tank, the processing solutions filled within the respective processing chambers flow downwardly via gravity. Accordingly, the leakage of the liquid or mixture of the processing solutions occurs.

As shown in FIG. 6, the multi-chambered processing tank is partitioned by the partitioning wall 103, which extends in the vertical direction, to form two processing chambers. When the conveying racks 109 and 111 are lifted separately from the processing chambers on both sides of the partitioning wall 103, hydraulic pressure of the respective liquid solutions on both sides of the partitioning wall 103 changes. Even if the processing solution partitioning member, which allows the passage of the photosensitive material, is provided at the lower end portion of the partitioning wall 103, washing waters, which have different concentrations and which are accommodated in separate processing chambers 105 and 107, mix with each other because the function of keeping the processing solutions apart deteriorates due to changes in the hydraulic pressure.

Moreover, according to the structure shown in FIG. 6, when the conveying rack 111 is lifted while the photosensitive material is jammed, the photosensitive material is simultaneously lifted since it is still nipped by the conveying roller pairs 113. If the processing solution partitioning member cannot follow vertical movements of the photosensitive material, the function of keeping the processing solutions apart is lost and the washing water having different concentrations is mixed beneath the partitioning wall 103 as previously described. This is one of the reasons why the concentration gradients of the processing solutions become uniform.

SUMMARY OF THE INVENTION

In view of the aforementioned drawbacks, an object of the present invention is to provide a photosensitive material processing apparatus in which the conveying racks for conveying and immersing the photosensitive material into the processing solutions can be mounted and removed without the mixing of the processing solutions which are accommodated within the multi-chambered processing tank.

According to the present invention, a photosensitive material processing apparatus comprising: a processing tank in which processing solutions are accommodated; at least one partitioning wall which forms a plurality of processing chambers by partitioning the processing tank, the partitioning wall forming a communicating portion so that a photosensitive material can pass through the processing chambers; a processing solution partitioning member provided at the communicating portion, the processing solution partitioning member preventing the mixing of the processing solutions which are respectively stored in the plurality of processing chambers, and the processing solution partitioning member allowing the photosensitive material to be moved from a processing chamber which is located upstream to an adjacent processing chamber which is located downstream, among the plurality of processing chambers; and a conveying rack which has a plurality of immersion portions which are provided so as to be able to be immersed in and lifted out from the plurality of processing chambers and has a connecting portion which connects the plurality of immersion portions so that the immersion portions are integral, the conveying rack having a plurality of conveying roller pairs, which convey the photosensitive material, and having supporting members, which are respectively provided at axial direction end portions of the plurality of conveying roller pairs so as to rotatably support the plurality of conveying roller pairs, the conveying rack conveying the photosensitive material from the processing chamber which is located upstream to the processing chamber which is located downstream, among the plurality of processing chambers, via the communicating portion while immersing the photosensitive material into the processing solutions, wherein among the plurality of conveying roller pairs, at least one of the plurality of conveying roller pairs, which is provided in the upstream processing chamber which is located upstream, is a one-way rotating conveying roller pair which is rotated only in a rotating direction corresponding to a direction of conveying the photosensitive material from the upstream processing chamber which is located upstream, to the processing chamber which is located downstream.

In the present invention, the processing solutions are accommodated within the plurality of processing chambers. The processing solutions may be of different types, or may be of the same type but having different concentrations and purities. Different types of processing solutions include a developing solution, a bleaching solution, a bleaching/fixing solution, fixing solution, a rinsing solution, a stabilizing solution, washing water and the like. The processing solutions can be combined appropriately on the processing. Washing water, which is used in a plurality of steps, is an example of processing solutions of the same type which can be applied to the present invention.

In accordance with the above-described present invention, a connecting portion of the conveying rack connects a plurality of immersion portions. Consequently, the conveying mechanisms, which are immersed in the plurality of processing chambers, can be simultaneously lifted up, and can be lifted up equally at all the processing chambers. Accordingly, the levels of the processing solutions in all the processing chambers are changed in the same way. The hydraulic pressure of the respective processing solutions is the same. The partitioning function of the processing solutions at a photosensitive material passing portion, which is located beneath the upper partitioning wall, is not reduced. Accordingly, the processing solutions are not mixed.

In addition, the conveying rollers of an upstream processing chamber is formed by one-way rotating conveying roller pair. Even if the conveying rack is lifted up while the photosensitive material is in a state of being interposed between all of the processing solution partitioning members, which are provided at open portions as the communicating portions, from the upstream processing chamber to the downstream processing chamber, the one-way rotating conveying roller pairs are rotated in the conveying direction of the photosensitive material. Therefore, the photosensitive material can be smoothly withdrawn from the conveying roller pairs.

Further, the processing solution partitioning member, which is provided at the lower end portion of the partitioning wall, serves as a blade which can be deformed in accordance with changes in the conveying path of the photosensitive material. Therefore, even if the conveying path is changed while the photosensitive material is being withdrawn from the conveying roller pairs, the sealing function of the processing solution partitioning member does not deteriorate and mixing of the processing solutions can be prevented.

Accordingly, when the conveying racks or the processing tank are being cleaned, or when a photosensitive material jam is being cleared, the processing solutions in the multi-chambered processing portion are not mixed. Thereafter, processing can be continued smoothly.

DESCRIPTION OF THE PREFERRED EMBODIMENTS

Next, a first embodiment of the present invention will be described with reference to FIGS. 1 through 3.

Figure 1:
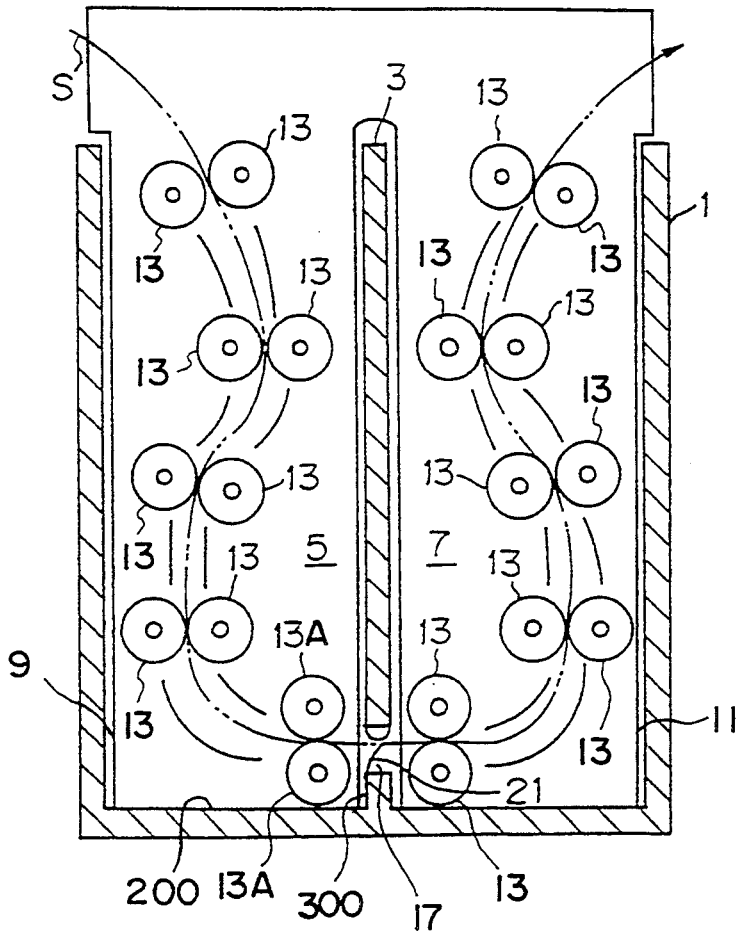
FIG. 1 is a vertical cross-sectional view of a processing tank according to a first embodiment of the present invention.
Figure 2:
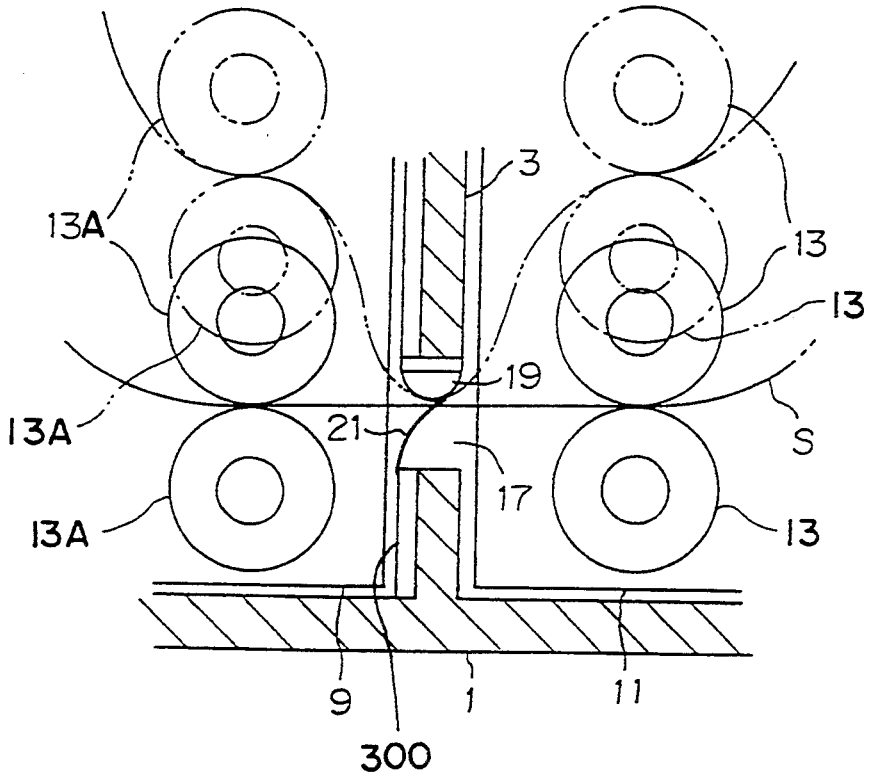
FIG. 2 is an enlarged vertical cross-sectional view of main portions of the processing tank.

FIG. 1 is a cross-sectional view of an processing tank. FIG. 2 is an enlarged cross-sectional view illustrating a structure of main portions of the processing tank. FIG. 3 is a perspective view of conveying racks which correspond to a plurality of processing tanks.

The present invention is applicable to a developing tank, a bleaching tank, a fixing tank, and a washing tank. An application to the washing tank will be described as an example.

As illustrated in FIG. 1, a processing tank 1 is partitioned by an upper partitioning wall 3 into two processing chambers 5 and 7. An open portion 17 is provided between a lower end portion of the upper partitioning wall 3 and a bottom wall portion 200 of the processing tank 1 so that the processing chambers 5 and 7 are communicable. Conveying racks 9 and 11 are provided at the processing tank 1 so as to be mountable and removable. The conveying racks 9 and 11 are provided so that photosensitive material S is conveyed below the lower end portion of the upper partitioning wall 3. The conveying racks 9 and 11 include plural pairs of conveying roller pairs 13. Having nipped the photosensitive material S, the conveying roller pairs 13 are rotated and driven so as to convey the photosensitive material S downward into the processing chamber 5, which is located on one side of the upper partitioning wall 3. Having nipped the photosensitive material S, the conveying roller pairs 13 are rotated and driven so as to convey the photosensitive material S upward in the processing chamber 7, which is located on the other side of the upper partitioning wall 3. The conveying racks 9 and 11 are respectively loaded into the processing chambers 5 and 7, which are located at the sides of the upper partitioning wall 3. It is obvious from FIG. 3 that side plates 209 and 211, which are provided at axial direction sides of the conveying roller pairs 13, are connected at an upper portion of the upper partitioning wall 3 so as to be formed integrally.

Among the conveying roller pairs 13 which are provided on the conveying rack 9, the conveying roller pairs which are disposed closest to the bottom wall portion 200 are structured as driving rollers, which have the driving force to convey the photosensitive material S to the processing chamber 7, and as one-way rotating rollers, which rotate only in the conveying direction of the photosensitive material S. An unillustrated driving means applies a driving force to one-way rotating rollers 13A. The driving force is transmitted to the one-way rotating rollers 13A via a clutch means, and is transmitted to the respective conveying rollers 13 via gears 15 shown in FIG. 3. Further, in a case in which the driving force is applied by the driving means to a plurality of conveying roller pairs 13, each of the conveying roller pairs 13 is constructed as a one-way roller.

The respective gears 15 continue to be engaged whether a rotational force by the driving means is exerted or not. Accordingly, in a case in which the one-way rotating rollers 13A are rotated by a force other than the driving means, for example, in a case in which they are rotated by withdrawing the photosensitive material S, the rotation is transmitted to the other conveying rollers 13 by the respective gears 15.

A bank 19 is fixed to a position which is at the lower end portion of the upper partitioning wall 3 and opposes the open portion 17. A tip end of the bank 19 is formed in the shape of an arc and serves as a protrusion for facilitating the conveyance of the photosensitive material S. A lower partitioning wall 300 is provided so as to stand upright in the direction which is substantially along the thickness direction of the bottom wall portion 200 and the tip end portion thereof opposes the open portion 17. A blade 21 is provided at the lower partitioning wall 300 so as to elastically abut an outer side surface of the bank 19. The blade 21 is formed by an elastic resin-made film or the like.

Figure 3:
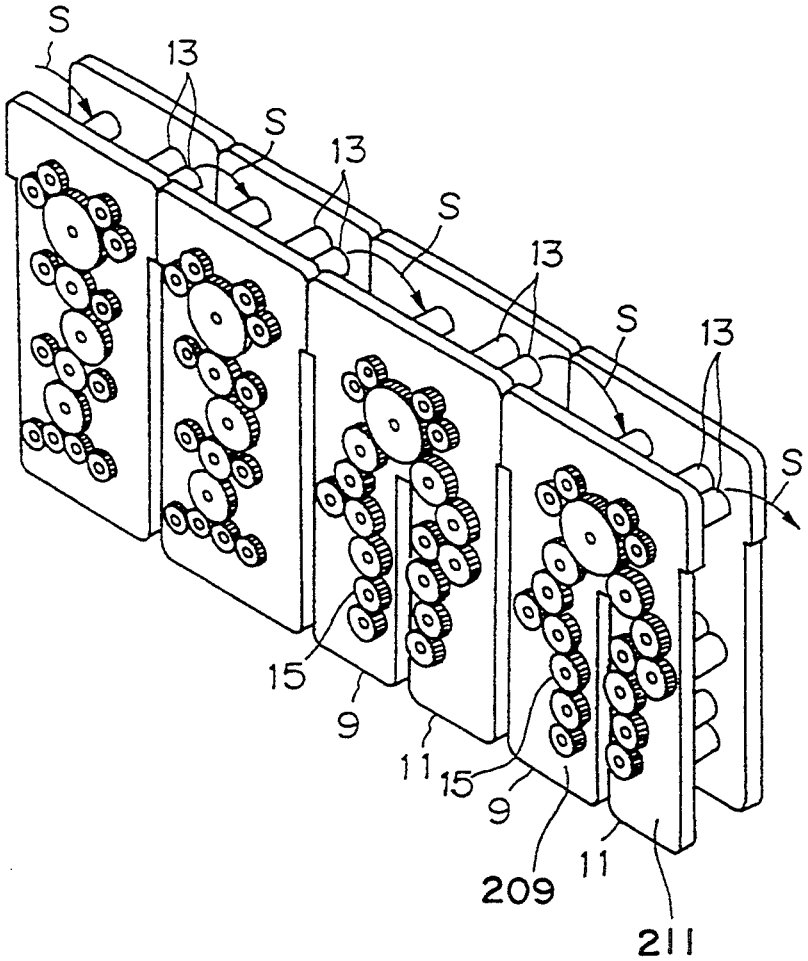
FIG. 3 is a perspective view of conveying racks which correspond to a plurality of processing tanks.

As shown by the arrows in FIGS. 1 and 3, in a case in which an wash processing is effected, the photosensitive material S is nipped and conveyed by the one-way rotating rollers 13A and the conveying rollers 13 of the conveying rack 9, which is located at the left side of the upper partitioning wall 3. Then, the photosensitive material S is provided between the bank 19 and the blade 21, nipped and conveyed by the respective conveying roller pairs 13 of the conveying rack 11, which is located at the right side of the upper partitioning wall 3, and immersed.

A description of lifting the conveying racks 9 and 11 will be given hereinafter.

The conveying racks 9 and 11 are simultaneously lifted from both sides of the upper partitioning wall 3. First, a description will be given of lifting of the conveying rack 9. The conveying rack 9 is loaded into the processing chamber 5, which is located on the left-hand side in FIG. 1 where the photosensitive material is inputted. When the driving of the one-way rotating rollers 13A by the driving means is stopped, conveyance of the photosensitive material S is stopped. When the conveying rack 9 is lifted from the processing chamber 5, the one-way rotating rollers 13A are moved upward from a position shown by a solid line to that shown by an imaginary line in FIG. 2. The one-way rotating rollers 13A are rotated in the same direction as the conveying direction of the photosensitive material due to friction with the photosensitive material S. The conveying roller pairs 13 are also rotated in the same direction as the conveying direction of the photosensitive material due to the operation of the gears 15.

Next, a description will be given of the lifting of the conveying rack 11. The conveying rack 11 is loaded into the processing chamber 7, which is located on the right-hand side in FIG. 1 where the photosensitive material is outputted. In case of the conveying rack 11 in the processing chamber 7, driving force introducing rollers are not one-way rotating rollers. The driving force introducing rollers are connected to the driving means and follow the rotation of the driving means. As far as the driving means is not rotated in the opposite direction of the conveying direction, the rollers cannot be rotated in the opposite direction. The photosensitive material S is nipped by the conveying rollers 13. By lifting the conveying rack 11 upward, the conveying rollers 13 are moved upward from a position shown by a solid line to that shown by an imaginary line in FIG. 2 while lifting a longitudinal direction intermediate portion of the photosensitive material S.

Namely, as the photosensitive material S is nipped and moved upward in the processing chamber 7 by the conveying roller pairs 13 of the conveying rack 11, the photosensitive material S is smoothly withdrawn from the conveying roller pairs 13, which are located in the processing chamber 5. At this time, the blade 21 deforms in accordance with changes in the moving path of the photosensitive material S and prevents the mixing of the washing water between the processing chambers 5 and 7.

According to the above-described structure, the photosensitive material S is conveyed in a state in which the photosensitive material S is pressed and contacted the bank 19 by the blade 21. Accordingly, the washing water is not mixed between the processing chambers 5 and 7 while the photosensitive material S is conveyed. Therefore, concentration gradients of the washing water in the processing chambers 5 and 7, which are located on both sides of the upper partitioning wall 3, are appropriately maintained. In addition, the conveying racks 9 and 11 are lifted simultaneously. However, due to the operation of the one-way rotating rollers 13A, the photosensitive material S is fed into the processing chamber 7 side where the photosensitive material S is outputted, and the conveying racks can be lifted and removed smoothly.

Figure 4A:
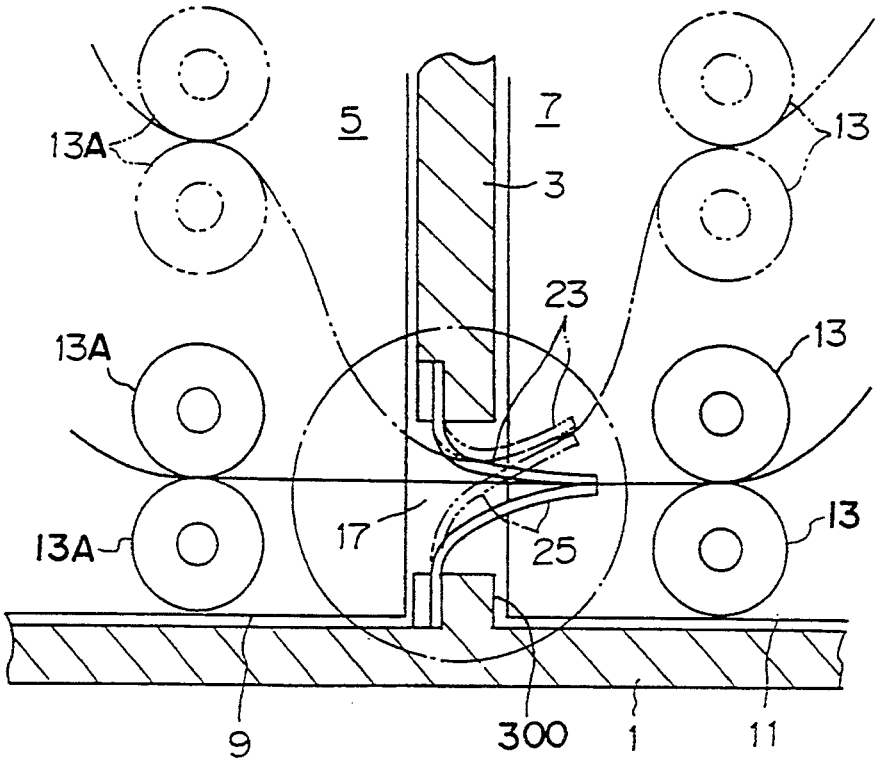
FIG. 4A is a vertical cross-sectional view of main portions of a processing tank according to a second embodiment of the present invention and in a case in which photosensitive material is inserted into the processing tank.
Figure 4B:
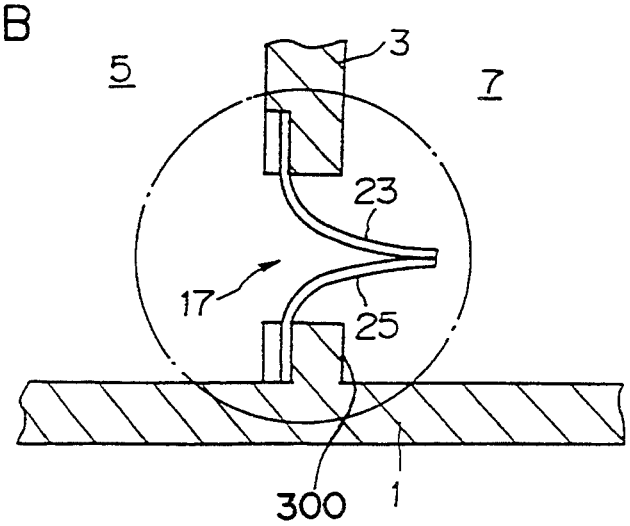
FIG. 4B is a vertical cross-sectional view of the main portions of the processing tank according to the second embodiment of the present invention and in a case in which the photosensitive material is not inserted into the processing tank.

Next, a second embodiment of the present invention will be described with reference to FIGS. 4A and 4B. FIGS. 4A and 4B are cross-sectional views of main portions of a washing tank. A principal difference between the first and second embodiments is providing a pair of blades 23 and 25 instead of the bank 19 and the blade 21 as previously described. Members which effect the same operation as those previously described are denoted with the same reference numerals, and descriptions thereof are omitted.

The first blade 23 is provided in a vicinity of the bottom portion of the processing tank 1 and in a vicinity of the lower end portion of the upper partitioning wall 3. The first blade 23 extends while being deformed in the shape of an arc so as to close the open portion 17 by half. The first blade 23 is formed along the moving direction of the photosensitive material S. Further, the second blade 25 is provided at the lower partitioning wall 300. In the vicinity of the bottom portion of the processing tank 1, the second blade 25 is symmetrically formed at a position which opposes the open portion 17 so as to abut the previously-described first blade 23.

The first and second blades 23 and 25 are formed, for example, by an elastic resin-made film or the like. In a case in which nothing is inserted between the blades 23 and 25, the tip end portions thereof elastically contact as shown in FIG. 4B. The washing water in the processing chamber 5 and the washing water in the processing chamber 7 can be prevented from being mixed.

When the photosensitive material S passes through the underside of the upper partitioning wall 3, the first and second blades 23 and 25 are at a substantially central position as shown by a solid line in FIG. 4A so as to elastically nip both surfaces of the photosensitive material S. Because the first and second blades 23, 25 are brought into close contact with the photosensitive material S, the washing water in the processing chamber 5 and the washing water in the processing chamber 7 are prevented from being mixed.

When the conveying racks 9 and 11 are respectively lifted from the processing chambers 5 and 7 while the photosensitive material S is in the conveying racks 9 and 11, the conveying roller pairs 13 of the conveying racks 9 and 11 continue to nip the photosensitive material S. Accordingly, the photosensitive material S is pulled upward by lifting the conveying racks 9 and 11 from the processing chambers 5 and 7. The first blade 23 is deformed from the shape shown by the solid line to the shape shown by the imaginary line in FIG. 4A.

We should note that both the first and second blades 23 and 25 are formed relatively long so that the second blade 25 can bring the photosensitive material S into contact with the surface of the first blade 23. As a result, when the photosensitive material S is withdrawn from the conveying rack 9 in the processing chamber 5 and is passed beneath the upper partitioning wall 3, the seal function is not impaired even if the moving path of the photosensitive material S varies. The solutions in the processing chambers on both sides of the upper partitioning wall 3 are not mixed.

Next, a third embodiment of the present invention will be described with reference to FIG. 5.

Figure 5:
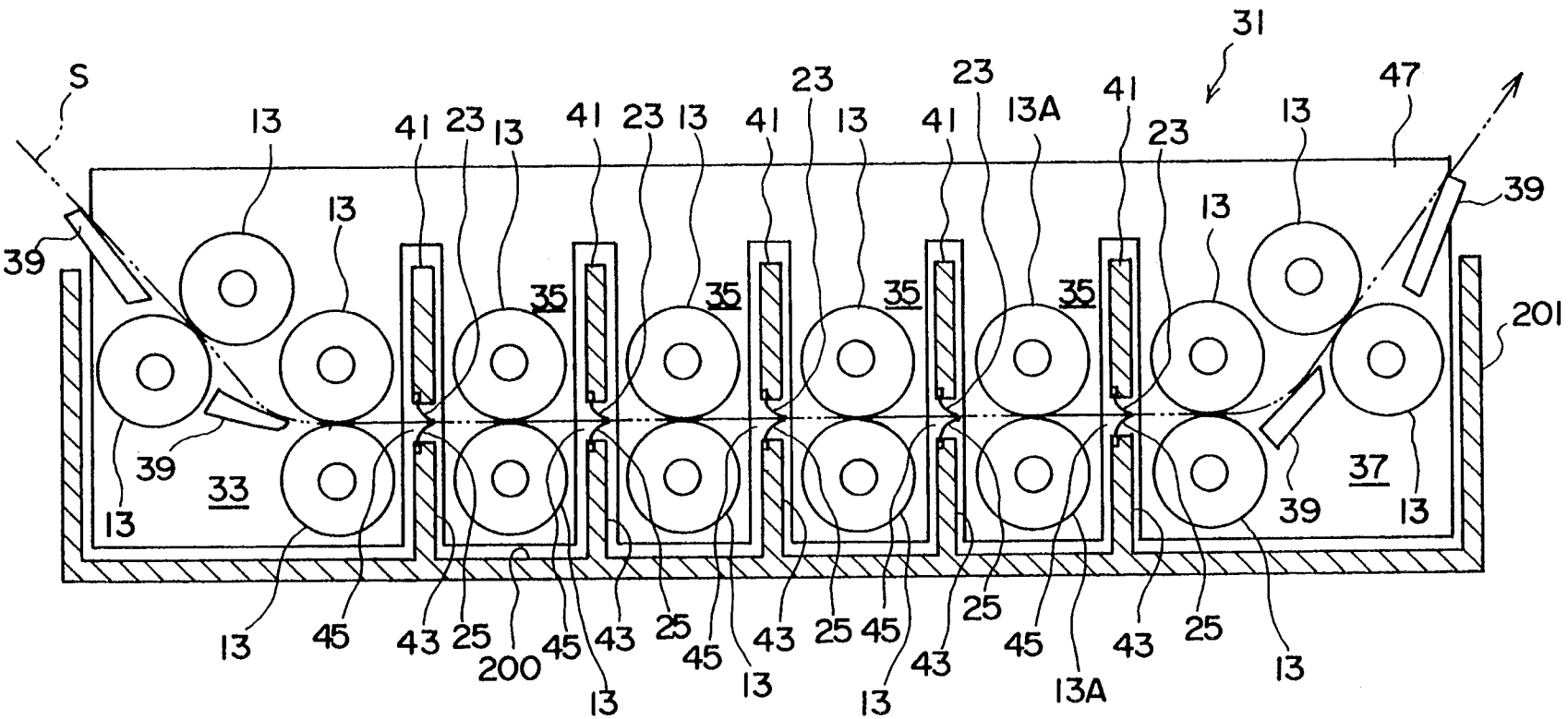
FIG. 5 is a vertical cross-sectional view of a processing tank according to a third embodiment of the present invention.
Figure 6:
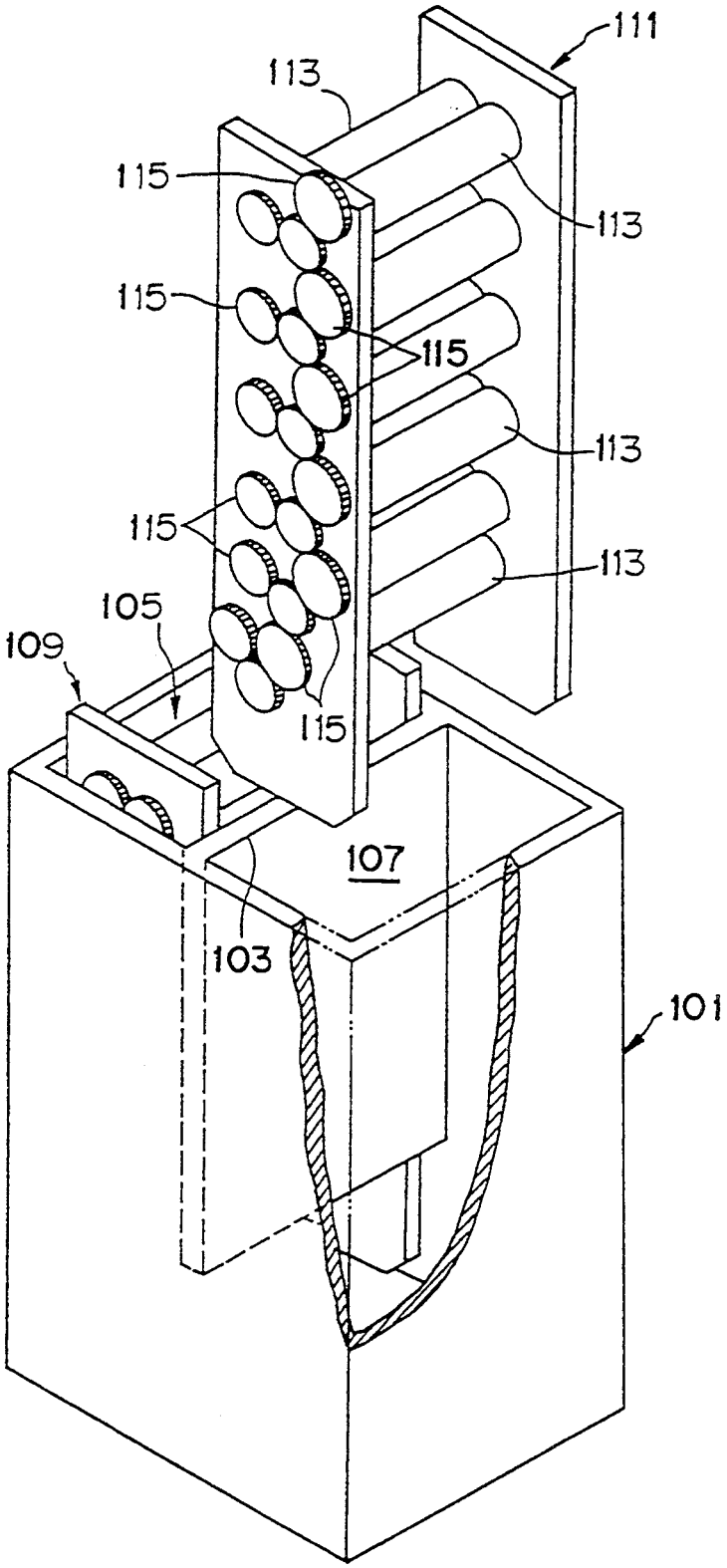
FIG. 6 is a perspective view of an example of a conventional processing tank.

FIG. 5 is a vertical cross-sectional view of a processing tank 201 illustrating a third embodiment of the present invention. Members which effect the same operations as those in the first and second embodiments are denoted by the same reference numerals, and descriptions thereof are omitted.

The processing tank 201 is partitioned by five partitioning walls 41 so as to form a total of six processing chambers 33, 35, 35, 35, 35 and 37, i.e., four processing chambers 35 are provided. Open portions 45 are respectively formed between a lower end portion of an upper partitioning wall 41 and an upper end portion of a lower partitioning wall 43, which is provided integrally with and so as to stand upright from a bottom portion of the processing tank 201, so that the processing chambers 33, 35, which are located on the upstream side with respect to the upper partitioning wall 41, communicate with the processing chambers 35, 37, which are located on the downstream side thereof. In addition, all of the open portions 45 are provided at substantially the same position in an intermediate portion of the processing tank 201 in the direction of the depth thereof. The first blades 23 are respectively attached to the lower end portions of the upper partitioning walls 41, and the second blades 25 are attached to the lower partitioning walls 43. The respective leading end portions of the first blade 23 and the second blade 25 are directed to the downstream side of the upper partitioning wall 41, and approach each other. Accordingly, the respective leading end portions of the first blades 23 and the second blades 25 contact elastically so as to prevent the mixing of the washing water stored at the upstream side of the upper partitioning wall 41 and the washing water stored at the downstream side thereof, are prevented from being mixed. A conveying rack 31 is provided at the processing tank 201 so as to be mountable and removable. The conveying rack 31 has the plurality of conveying roller pairs 13, one conveying roller pair 13A and side plates 47, which are provided at the axial direction end portions of the plurality of conveying roller pairs 13, 13A and which rotatably support the plurality of conveying roller pairs 13, 13A. In the processing chamber 33 which is the furthest upstream processing chamber of the processing tank 201, the conveying roller pairs 13 are rotatably driven so as to convey the photosensitive material S downwardly in the processing chamber 33 while nipping the photosensitive material S which is guided by a guide plate 39. In the processing chambers 35 which are located at the intermediate portion of the conveying path of the photosensitive material S, the conveying roller pairs 13, 13A are rotatably driven so as to convey the photosensitive material S toward the open portions 45 which are located at the downstream side while nipping the photosensitive material S. In the processing chamber 37 which is furthest downstream processing chamber of the processing tank 201, the conveying roller pairs 13, together with the guide plates 39, guide the photosensitive material S upwardly in the processing chamber 37. The conveying roller pair 13A located in the processing chamber 35 of furthest downstream of the processing chambers 35 is a one-way rotating roller pair which is freely rotatable only in the conveying direction. When an unillustrated driving means is operated, driving force is applied to the conveying roller pair 13A in the conveying direction of the photosensitive material S via an unillustrated clutch means. As in the first embodiment, driving force is transmitted from the conveying roller pair 13A to the conveying roller pairs 13, which are located in the processing chamber 33 and the other processing chambers 35, via unillustrated gears. Accordingly, the conveying roller pairs 13 which are located in the processing chambers 33, 35 substantially function as one-way rotating rollers. Further, the conveying roller pairs 13, which are located in the processing chamber 37, are connected to an unillustrated driving means. The conveying roller pairs 13 are provided so as to be rotated only by operation of the driving means, for example, by the resistance force of the driving means. Accordingly, when the driving means is not operated, the conveying roller pairs 13 continue to nip the photosensitive material S.

Washing water is stored in the processing chambers 33, 35 and 37 of the processing tank 201 structured as described above. Washing water is first supplied to the processing chamber 37. Then, the washing water which overflows from the processing chamber 37 is successively supplied to the processing tanks 35, 33 at the upstream side of the conveying path due to the overflow of the washing water.

After the photosensitive material S is conveyed from the outside of the processing tank 201 to the processing chamber 33, and is immersed into the washing water while being guided by a guide plate 39 and while being nipped and conveyed by the conveying roller pairs 13. While the photosensitive material S is immersed in the washing water, the photosensitive material S is successively conveyed to the processing chamber 35 through the first blade 23 and the second blade 25 which are provided at the open portion 45 which is positioned at the downstream side of the conveying path. The photosensitive material S which is conveyed to the processing chamber 35 is conveyed toward the first blade 23 and the second blade 25 which are positioned at the downstream side of the conveying path. Thereafter, the photosensitive material S, which passes through the first blade 23 and the second blade 25, is conveyed into the three processing chambers 35 which are positioned at the downstream side of the conveying path in the same manner as described above. Further, at the processing chamber 35 which is the furthest downstream processing chamber among the four processing chambers 35, the conveying roller pair 13A, rather than the conveying roller pair 13, nips and conveys the photosensitive material S. Finally, the photosensitive material S is conveyed to the processing chamber 37 while being immersed in the washing water, and is then moved from the washing water to the outside of the processing tank 201 while being guided by the guide plate 39 and nipped and conveyed by the conveying roller pairs 13. Accordingly, in the present embodiment, the photosensitive material S is always conveyed in washing water, from the time when the photosensitive material S is conveyed into the washing water stored in the processing chamber 33 to the time when the photosensitive material S is moved from the washing water stored in the processing chamber 37 to the outside of the processing tank 201. Therefore, as described above, the photosensitive material S is subject to processing by the washing water in the processing chambers 33, 35 and 37 while being conveyed in the processing chamber 33, 35 and 37.

If the conveying rack 31 is lifted up from the processing tank 201 while the photosensitive material S is in a state of being interposed between all of the first and second blades 23, 25, which are provided at the open portions 45, from the processing chamber 33 through the processing chambers 35 to the processing chamber 37, the conveying roller pairs 13 which are located at the processing chamber 37 nip a longitudinal direction intermediate portion of the photosensitive material S and lift up the photosensitive material S from the processing tank 201 while the conveying rack 31 being moved. In addition, the conveying roller pairs 13 are rotatable in the same direction as the conveying direction of the photosensitive material S together with the conveying roller pair 13A because the driving force of the conveying roller 13A is transmitted to the conveying roller pairs 13 and the conveying roller pairs 13 function substantially as one-way rotating roller pairs. Accordingly, the photosensitive material S, which is positioned in the processing chambers 33 and 35 and whose leading end is nipped by the conveying roller pairs 13 of the processing chamber 37, is smoothly drawn out from between the conveying roller pairs 13 and the conveying roller pair 13A and is removed from the processing tank 201 while the conveying rack 31 is being moved, so that the conveying rack 31 can be smoothly lifted up from the processing tank 201. Further, the respective leading end portions of the first blade 23 and the second blade 25, both of which are provided at the open portion 45, contact elastically. Therefore, even if, due to the lifting up of the conveying rack 31, the conveying path of the photosensitive material S is changed from the conveying path at the time when the photosensitive material S is being subject to washing water processing, the washing water, which is stored at the upstream side of the upper partitioning wall 41, and the washing water, which is stored at the downstream side thereof, are prevented from being mixed.

What is claimed is:

1. A photosensitive material processing apparatus comprising:

a processing tank in which processing solutions are accommodated;

at least one partitioning wall which forms a plurality of processing chambers by partitioning said processing tank, said partitioning wall forming a communicating portion so that a photosensitive material can pass through said processing chambers;

a processing solution partitioning member provided at said communicating portion, said processing solution partitioning member preventing the mixing of the processing solutions which are respectively stored in said plurality of processing chambers, and said processing solution partitioning member allowing said photosensitive material to be moved from a processing chamber which is located upstream to an adjacent processing chamber which is located downstream, among said plurality of processing chambers; and a conveying rack which has a plurality of immersion portions which are provided so as to be able to be immersed in and lifted out from said plurality of processing chambers and has a connecting portion which connects said plurality of immersion portions so that said immersion portions are integral, said conveying rack having a plurality of conveying roller pairs, which convey said photosensitive material, and having supporting members, which are respectively provided at axial direction end portions of said plurality of conveying roller pairs so as to rotatably support said plurality of conveying roller pairs, said conveying rack conveying said photosensitive material from the processing chamber which is located upstream to the processing chamber which is located downstream, among said plurality of processing chambers, via said communicating portion while immersing said photosensitive material into said processing solutions, wherein among said plurality of conveying roller pairs, at least one of the plurality of conveying roller pairs, which is provided in said upstream processing chamber which is located upstream, is a one-way rotating conveying roller pair which is rotated only in a rotating direction corresponding to a direction of conveying said photosensitive material from said upstream processing chamber which is located upstream, to said processing chamber which is located downstream.

2. A photosensitive material processing apparatus according to claim 1, wherein said processing solution partitioning member is an elastic plate-shaped member which can be deformed in accordance with changes in a conveying path of said photosensitive material.

3. A photosensitive material processing apparatus according to claim 2, wherein said elastic plate-shaped member is a blade in which a vicinity of one end portion is fixed to said partitioning wall and a vicinity of the other end portion is provided so as to be able to abut and so as to be able to move apart from said partitioning wall.

4. A photosensitive material processing apparatus according to claim 2, wherein said elastic plate-shaped member has a first blade, in which a vicinity of one end portion is fixed to an upper partitioning wall which is provided at said partitioning wall, and has a second blade, in which a vicinity of one end portion is fixed to a lower partitioning wall which is provided at said partitioning wall, and respective other end portions of said first and second blades are provided so as to be able to abut each other and so as to be able to move apart from each other.

5. A photosensitive material processing apparatus according to claim 1, further comprising:

driving means for applying driving force to said one-way rotating conveying roller pair and at least one of the plurality of conveying roller pairs, which are provided in the processing chamber which is furthest downstream among said plurality of processing chambers.

6. A photosensitive material processing apparatus according to claim 5, wherein each of said plurality of conveying roller pairs has a driving force transmitting means, and said driving force transmitting means transmits the driving force applied by said driving means to at least one of said plurality of conveying roller pairs.

7. A photosensitive material processing apparatus according to claim 5, wherein when the operation of said driving means is stopped, said driving means prevents rotation of at least one of the plurality of conveying roller pairs, which are provided in the processing chamber which is furthest downstream among said plurality of processing chambers, to which the driving force is applied.

8. A photosensitive material processing apparatus according to claim 1, wherein said supporting members are formed by one plate-shaped member.

9. A photosensitive material processing apparatus according to claim 1, wherein said plurality of processing chambers are washing processing chambers.

10. A photosensitive material processing apparatus comprising:

a processing tank in which processing solutions are accommodated;

a partitioning wall which forms a first processing chamber and a second processing chamber by extending along a vertical direction of said processing tank and partitioning said processing tank, said partitioning wall forming a communicating portion so that a photosensitive material can pass between a lower partitioning wall of said partitioning wall and an upper partitioning wall of said partitioning wall;

a blade provided at said communicating portion, a vicinity of one end portion of said blade being fixed to said partitioning wall and a vicinity of an other end portion of said blade being provided so as to be able to abut and so as to be able to move apart from said partitioning wall, said blade preventing the mixing of the processing solutions which are respectively stored in said first processing chamber and said second processing chamber, said blade allowing said photosensitive material to be moved from said first processing chamber to said second processing chamber; and a conveying rack in which a vicinity of one end portion is provided so as to be able to be immersed in and lifted out from said first processing chamber, a vicinity of another end portion is provided so as to be able to be immersed in and lifted out from said second processing chamber similarly to movement of the vicinity of said one end portion, an intermediate portion is provided so as to connect said one end portion and said another end portion, said conveying rack having a plurality of conveying roller pairs, which convey said photosensitive material, and including side plates, which are respectively provided in the vicinity of axial direction end portions of said plurality of conveying roller pairs so as to axially support said plurality of conveying roller pairs, said conveying rack conveying said photosensitive material from said first processing chamber to said second processing chamber via said communicating portion while immersing said photosensitive material into said processing solutions, wherein among said plurality of conveying roller pairs, at least one of the plurality of conveying roller pairs, which are provided in said first processing chamber, is a one-way rotating conveying roller pair which is rotated only in a rotating direction corresponding to a direction of conveying said photosensitive material from said first processing chamber to said second processing chamber.

11. A photosensitive material processing apparatus according to claim 10, wherein the lower end portion of said partitioning wall has a protrusion, whose cross-sectional configuration is in the form of an arc, and said protrusion facilitates conveyance of said photosensitive material.

12. A photosensitive material processing apparatus according to claim 10, further comprising:

driving means which applies a driving force to said one-way rotating conveying roller pair and at least one of the plurality of conveying roller pairs provided in said second processing chamber.

13. A photosensitive material processing apparatus according to claim 12, wherein each of said plurality of conveying roller pairs has at least one gear at an axial direction end portion of said conveying roller pair, and said gear transmits the driving force applied by said driving means to at least one of the gears provided at said plurality of conveying roller pairs.

14. A photosensitive material processing apparatus according to claim 12, wherein when the operation of said driving means is stopped, said driving means prevents rotation of at least one of the plurality of conveying roller pairs, which are provided in said second processing chamber, to which the driving force is applied.

15. A photosensitive material processing apparatus according to claim 10, wherein said side plate is formed by one plate-shaped member.

16. A photosensitive material processing apparatus comprising:

a processing tank in which processing solutions are accommodated;

a partitioning wall which forms a first processing chamber and a second processing chamber by extending along a vertical direction of said processing tank and partitioning said processing tank, said partitioning wall forming a communicating portion so that a photosensitive material can pass between a lower partitioning wall of said partitioning wall and an upper partitioning wall of said partitioning wall;

an elastic plate-shaped member provided at said communicating portion, which has a first blade in which a vicinity of one end portion is fixed to said upper partitioning wall, and has a second blade in which a vicinity of one end portion is fixed to said lower partitioning wall, respective other end portions of said first and second blades being provided so as to be able to abut each other and so as to be able to move apart from each other, said elastic plate-shaped member preventing the mixing of the processing solutions which are respectively stored in said first and second processing chambers, said elastic plate-shaped member allowing said photosensitive material to be moved from said first processing chamber to said second processing chamber; and a conveying rack in which a vicinity of one end portion is provided so as to be able to be immersed in and lifted out from said first processing chamber, a vicinity of another end portion is provided so as to be able to be immersed in and lifted out from said second processing chamber similarly to movement of the vicinity of said one end portion, an intermediate portion is provided so as to connect said one end portion and said another end portion, said conveying rack having a plurality of conveying roller pairs, which convey said photosensitive material, and having side plates, which are respectively provided in the vicinity of axial direction end portions of said plurality of conveying roller pairs so as to axially support said plurality of conveying roller pairs, said conveying rack conveying said photosensitive material from said first processing chamber to said second processing chamber via said communicating portion while immersing said photosensitive material into said processing solutions, wherein among said plurality of conveying roller pairs, at least one of the plurality of conveying roller pairs, which are provided in said first processing chamber, is a one-way rotating conveying roller pair which is rotated only in a rotating direction corresponding to a direction of conveying said photosensitive material from said first processing chamber to said second processing chamber.

17. A photosensitive material processing apparatus according to claim 16, further comprising:

driving means which applies a driving force to said one-way rotating conveying roller pair and at least one of the plurality of conveying roller pairs provided in said second processing chamber.

18. A photosensitive material processing apparatus according to claim 17, wherein each of said plurality of conveying roller pairs has at least one gear at an axial direction end portion of said conveying roller pair, and said gear transmits the driving force applied by said driving means to at least one of the gears provided at said plurality of conveying roller pairs.

19. A photosensitive material processing apparatus according to claim 17, wherein when the operation of said driving means is stopped, said driving means prevents rotation of at least one of the plurality of conveying roller pairs, which are provided in said second processing chamber, to which the driving force is applied.

20. A photosensitive material processing apparatus according to claim 16, wherein said side plate is formed by one plate-shaped member.

* * * * *